US007140363B2

(12) United States Patent
Armanni

(10) Patent No.: US 7,140,363 B2
(45) Date of Patent: Nov. 28, 2006

(54) GAS BURNER CROWN FOR KITCHEN HOBS

(75) Inventor: Piero Armanni, Forli (IT)

(73) Assignee: SO. M. I. Press - Societa' Metalli Iniettati S.p.A., Castelfidardo (IT)

( * ) Notice: Subject to any disclaimer, the term of this patent is extended or adjusted under 35 U.S.C. 154(b) by 0 days.

(21) Appl. No.: 11/007,816

(22) Filed: Dec. 8, 2004

(65) Prior Publication Data

US 2005/0194001 A1 Sep. 8, 2005

(51) Int. Cl.
*F24C 15/10* (2006.01)
*F24C 15/20* (2006.01)

(52) U.S. Cl. ..... 126/214 R; 126/211; 126/299 E

(58) Field of Classification Search ..... 126/39 E, 126/211, 214 R, 215, 40, 39 B, 299 C
See application file for complete search history.

(56) References Cited

U.S. PATENT DOCUMENTS 5,002,038 A * 3/1991 Riehl ..... 126/39 R
5,040,970 A * 8/1991 Riehl ..... 431/264
5,149,262 A 9/1992 Riehl ..... 431/258
5,160,256 A * 11/1992 Riehl ..... 431/266
5,328,357 A * 7/1994 Riehl ..... 431/266
5,492,469 A * 2/1996 Oda et al. ..... 431/266
5,961,311 A * 10/1999 Moore, Jr. ..... 431/6

* cited by examiner

*Primary Examiner*—Cheryl Tyler
*Assistant Examiner*—Michael J. Early
(74) *Attorney, Agent, or Firm*—Armstrong, Kratz, Quintos, Hanson & Brooks, LLP

(57) ABSTRACT

The present invention refers to a gas burner crown for kitchen hob, of the type with a radial series of notches, composed of shallower notches alternated with deeper notches, which act as small burner nozzles, from which small radial flames originate; the crown is characterised by the presence of eight regularly spaced angular sectors with shallower radial notches.

1 Claim, 2 Drawing Sheets

GAS BURNER CROWN FOR KITCHEN HOBS

The present patent application refers to a gas burner crown for kitchen hobs that allows for using cross or X-shaped pan supports without having to rotate the crown by 45°.

The model of the invention is an improvement of the crowns that are currently available on the market for gas burners of kitchen hobs with pan supports.

Gas burners are composed of a hollow truncated-conical body provided with nozzle for connection to the gas supply pipe and a notched crown placed on the edge of the body that supports a circular cap, in such a way that gas invades the burner body and blows through the dense series of radial notches on the upper edge of the crown.

The crown is matched with the burner body in such a way as to prevent free rotation, due to the presence of teeth under the crown that match corresponding housings of the burner body.

The gas supply pipe is connected to the burner body fixed under the hob by means of suitable support brackets, which do not allow for changing the position of the burner body, which is pre-determined according to the configuration of the pan supports with cross or X shape.

It must be noted that the presence of the pan supports impairs gas combustion, because of the cooling suffered by flames when they reach the support metal arms, preventing complete combustion and producing carbon monoxide instead of carbon dioxide.

To solve, or at least limit, this problem, the intensity of the flames is decreased where the pan support arms surmount the crown, in such a way that, being shorter, the flames cannot reach the support arms.

This is possible thanks to the shape of the gas burner crown, which is provided with a series of radial notches with same depth, except for the four areas underneath the spokes of the cross pan support, thus reducing or interrupting the flame at 90° intervals.

For the aforementioned reasons, the construction and position of gas burners on hobs have been so far restrained by the design of the pan supports.

The drawback of this type of burners resides in the fact that crowns are designed for application in a specific structure. In fact, in case of modifications to the pan support design for commercial or esthetical reasons, i.e. from cross spokes to X-shaped spokes, modifications to the position of burner body, gas connection pipes and cocks are also needed.

The solution to the problem is represented by the crown of the invention, characterised by higher versatility than currently available models, being provided with eight interruption or reduction points of flame intensity at 45° interval.

Such a solution has been devised in order to allow for modifying the design of pan supports.

The crown of the invention makes it possible to change the design of pan supports from cross to X-shape or vice versa, without having to modify the housing and fixing of burners and the position of the gas supply pipe.

U.S. Pat. No. 5,149,262 describes a gas cooker burner provided with a crown featuring nine subsequent angular sectors with radial notches spaced out by likewise sections which does not feature radial notches, one of said sections housing an electrically conductive L-shaped electrode. The height of said crown varies since the nine angular sections without radial notches are recessed below with respect to the sectors with radial notches, so as to carry-over flame means between each set of port means, so that once ignition of fuel issuing from one or more port means is accomplished by an igniter assembly of this invention in the manner hereinafter set forth, flame propagation will be provided completely around the burner body means at each port means thereof.

For major clarity the description of the invention continues with reference to the enclosed drawings, which are intended for purposes of illustration and not in a limiting sense, whereby:

Figure 1:
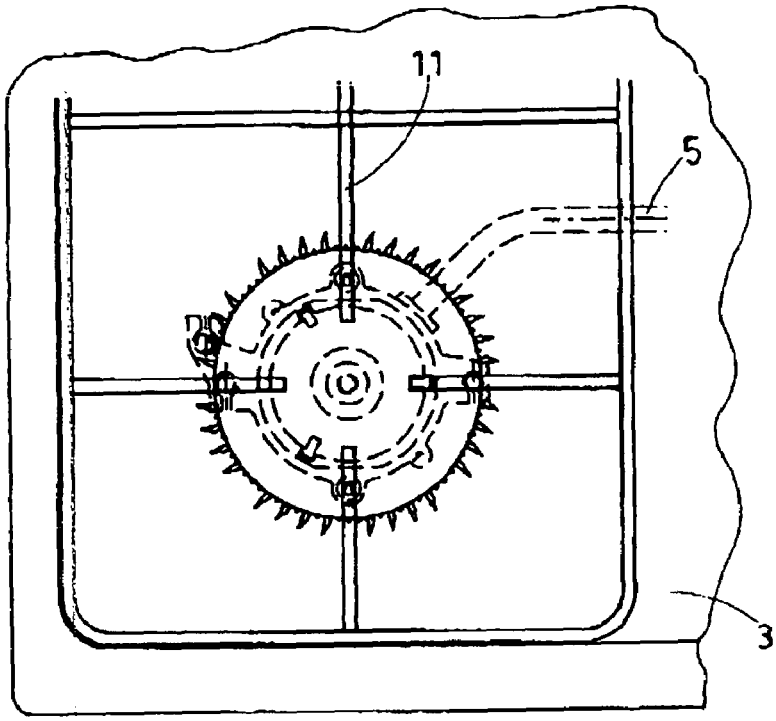
FIG. 1 is the top view of a hob with cross pan support.
Figure 2:
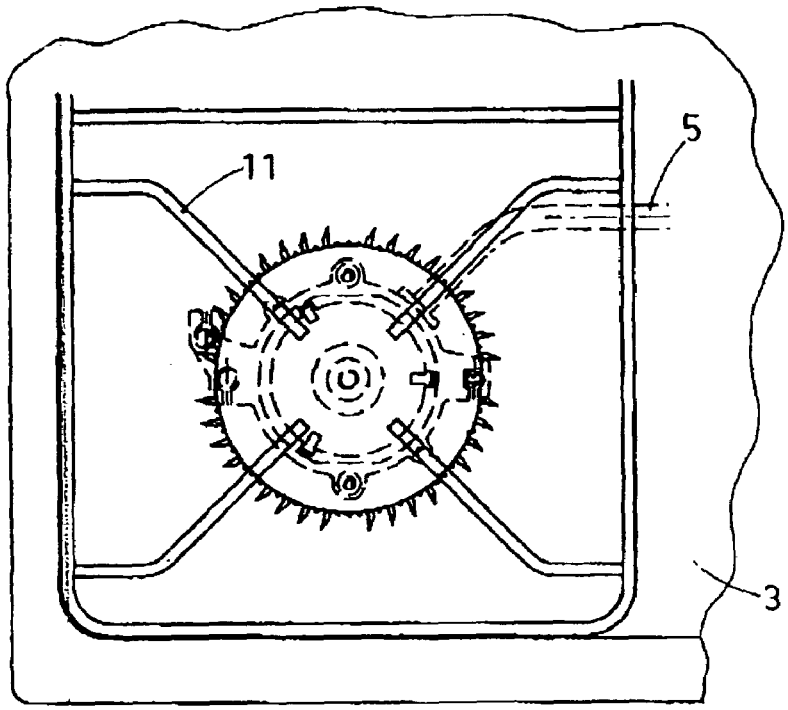
FIG. 2 is the top view of a hob with X-shaped pan support.

With reference to the aforementioned figures the crown (1) of the invention is designed for use in traditional gas burners composed of a body (2) with perimeter brackets (2*a*) for stable fixing underneath the hob (3), over which the crown (1) with cover cap (4) is placed.

The body (2) is externally provided with a radial nozzle (2*b*) connected to the gas supply pipe (5), which is located under the hob (3). The nozzle (2*b*) ends into a hole (2*c*) on the bottom of the body (2), provided on the upper edge with regularly spaced internal housings (2*d*), which exactly house teeth positioned under the crown (1) to prevent the free rotation of the crown (1) with respect to the body (2).

The cap (4) is placed on the crown (1) having a series of regularly spaced radial notches, acting as small burner nozzles, from which small radial flames originate.

Figure 3:
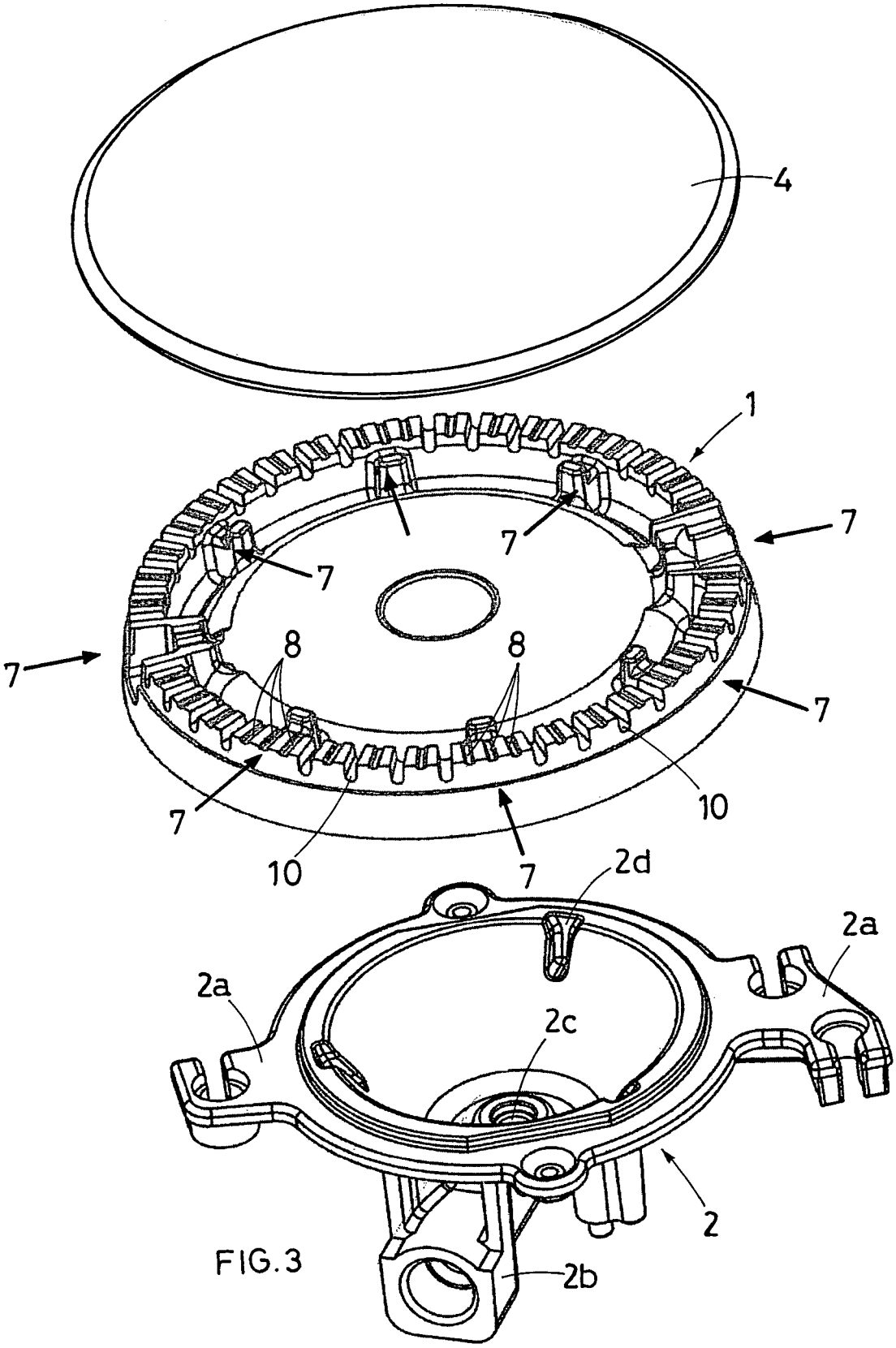
FIG. 3 is a perspective exploded view of burner components.

The peculiarity of the crown (1) of the invention is represented by the presence of eight regularly spaced angular sectors (7) (shown with arrows in FIG. 3) with shallower radial notches, in such a way that smaller notches (8) originate shorter flames than larger notches (10).

The sectors (7) are placed under the arms of the pan support (11); more exactly, in case of cross pan supports, the sectors (7) are positioned at three, six, nine and twelve hour, while in case of X-shaped pan supports, the sectors (7) are positioned at one and a half, four and a half, seven and a half, ten and a half hour.

This means that the crown (1) of the invention can be used with cross or X-shaped pan supports, without having to rotate the crown (1) and change the fixing position of the body (2) of the burner underneath the hob (3) and without the risk for the pan support arms to cause incomplete combustion.

Finally, it must be pointed out that the height of the crown (1) does not vary, so that the upper surface of said sections (7), featuring a concentration of smaller notches (8), lies on the same horizontal plane as the remaining annular surface of the crown (1), along which the larger notches (10) are provided.

The invention claimed is:

1. Gas burner crown for kitchen hobs, of the type used in traditional gas burners, composed of a body (2) with perimeter brackets (2*a*) for stable fixing underneath the hob (3) over which the crown (1) is placed, having a series of radial notches, composed of regularly spaced shallower notches (8) alternated with deeper notches (10), which act as small burner nozzles, from which small radial flames originate, crown being characterised by the presence of eight regularly spaced angular sectors (7), with shallower regularly spaced radial notches (8) and also characterized in that the upper surface of said section (7), featuring a concentration of regularly spaced smaller notches (8), lies on the same horizontal plane as the remaining annular surface of the crown (1), along which the larger notches (10) are provided.

* * * * *